United States Patent [19]

Wojtyna

[11] 3,987,870

[45] Oct. 26, 1976

[54] MAST ASSEMBLY

[75] Inventor: Elias Wojtyna, Strongsville, Ohio

[73] Assignee: Towmotor Corporation, Mentor, Ohio

[22] Filed: Nov. 3, 1975

[21] Appl. No.: 628,684

[52] U.S. Cl. ..... 187/9 R; 214/DIG. 11

[51] Int. Cl.[2] ..... B66B 9/20

[58] Field of Search ..... 187/9 R, 9 E, 17; 254/190 R; 214/650–654, 660, 670–674, 730, 731, 620, DIG. 11, 75 R, 95 R

[56] References Cited

UNITED STATES PATENTS

| | | | |
|---|---|---|---|
| 2,513,928 | 7/1950 | Frischmann | 187/9 E X |
| 2,622,751 | 12/1952 | Shaffer | 214/DIG. 11 |
| 2,791,293 | 5/1957 | Schenkelberger | 214/DIG. 11 |
| 3,062,325 | 11/1962 | Quayle | 187/9 E |
| 3,080,943 | 3/1963 | Goodall | 214/DIG. 11 |
| 3,166,208 | 1/1965 | Quayle | 214/DIG. 11 |
| 3,462,028 | 8/1969 | Pi | 187/9 E X |
| 3,777,853 | 12/1973 | Miller | 187/9 R |
| 3,930,563 | 1/1976 | Abels | 187/9 E |

*Primary Examiner*—Johnny D. Cherry
*Assistant Examiner*—James L. Rowland
*Attorney, Agent, or Firm*—Frank L. Hart

[57] ABSTRACT

A mast assembly has pulley means associated with sheaves of a lift chain for maintaining a hydraulic hose of the mast assembly at a protected position adjacent the chain.

4 Claims, 3 Drawing Figures

MAST ASSEMBLY

BACKGROUND OF THE INVENTION

Mast assemblies, as for example disclosed in U.S. Pat. No. 2,622,751 — Shaffer, which issued Dec. 23, 1962 from an application filed Aug. 4, 1949, have a hydraulic hose that is associated and movable with an elevatable carriage. In the operation of the carriage, one end of the hose is carried from about ground level to an elevated position. It therefore becomes important to provide means for protecting the hose during movement of the carriage. If such protecting means is not utilized, the relatively long length of hose may become entangled with associated equipment and further movement of the carriage may result in damaging or severing the hose. The hose protection means of this invention also protects the hose against damage from objects being transported by the lift truck.

This invention therefore resides in an improved mast assembly which protects a hose of the assembly from entanglement with adjacent objects and from impact and abrasion from objects transported by the mast assembly.

DETAILED DESCRIPTION OF THE INVENTION

Figure 1:
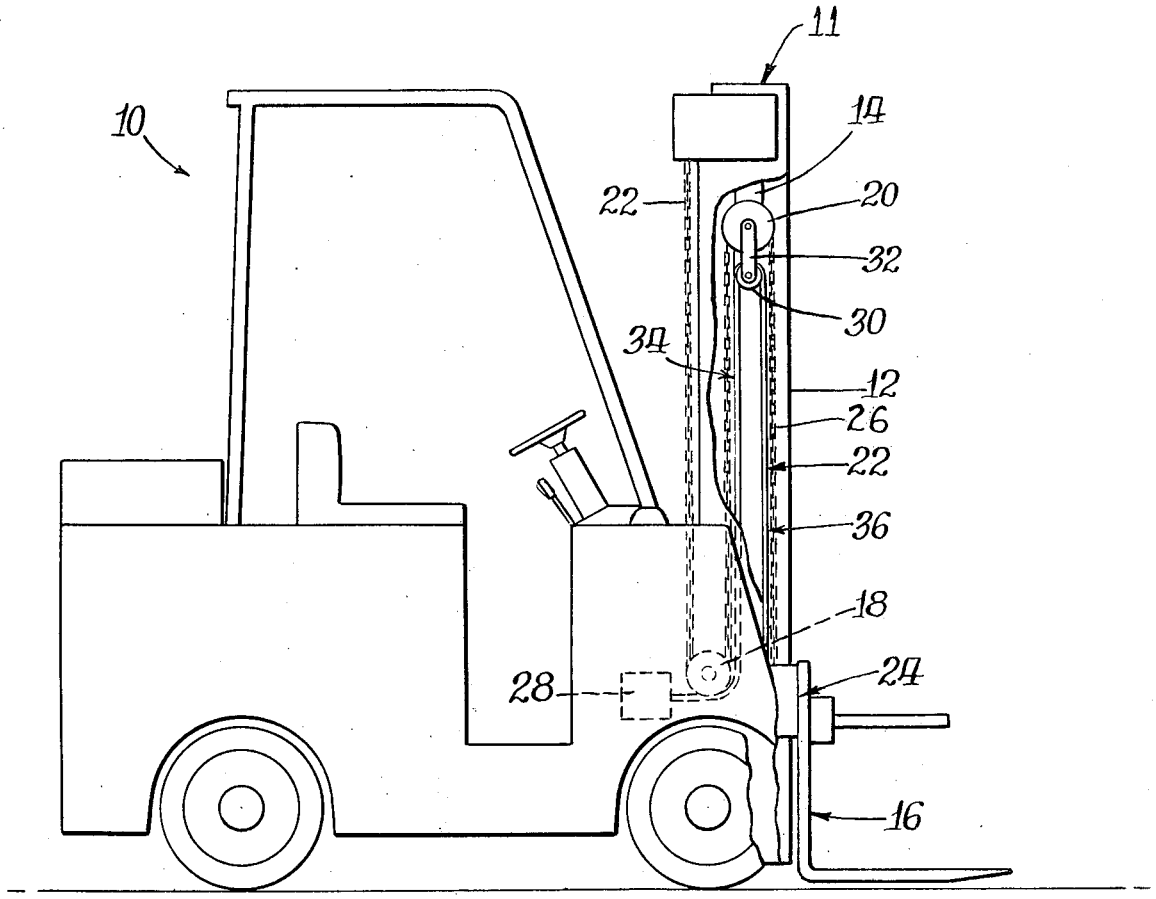
FIG. 1 is a diagrammatic view of a lift truck having the apparatus of this invention.

Referring to FIG. 1, a lift truck 10, for example, has a mast assembly 11 having a mast 12, a piston cylinder elevating mechanism 14 associated with the mast 12, a carriage 16 connected to mechanism 14, a first sheave 18 connected to a portion of the mast 12 at a first elevation, and a second sheave 20 connected to the piston cylinder elevating mechanism 14 at a higher second elevation. A chain 22 is connected at one end to the carriage 16 and at the other end to a portion of the mast 12. The chain 22 is supported by the first and second sheaves 18, 20 and extends under the first sheave 18 and over the second sheave 20. A fluid activated device 24 is carried by the carriage 16 and operably connected via at least one resilient hose 26 to a fluid pump 28. The operation of the lift truck 10 and fluid actuated device, such as means for hydraulically side shifting a carriage, are known in the art.

Figure 2:
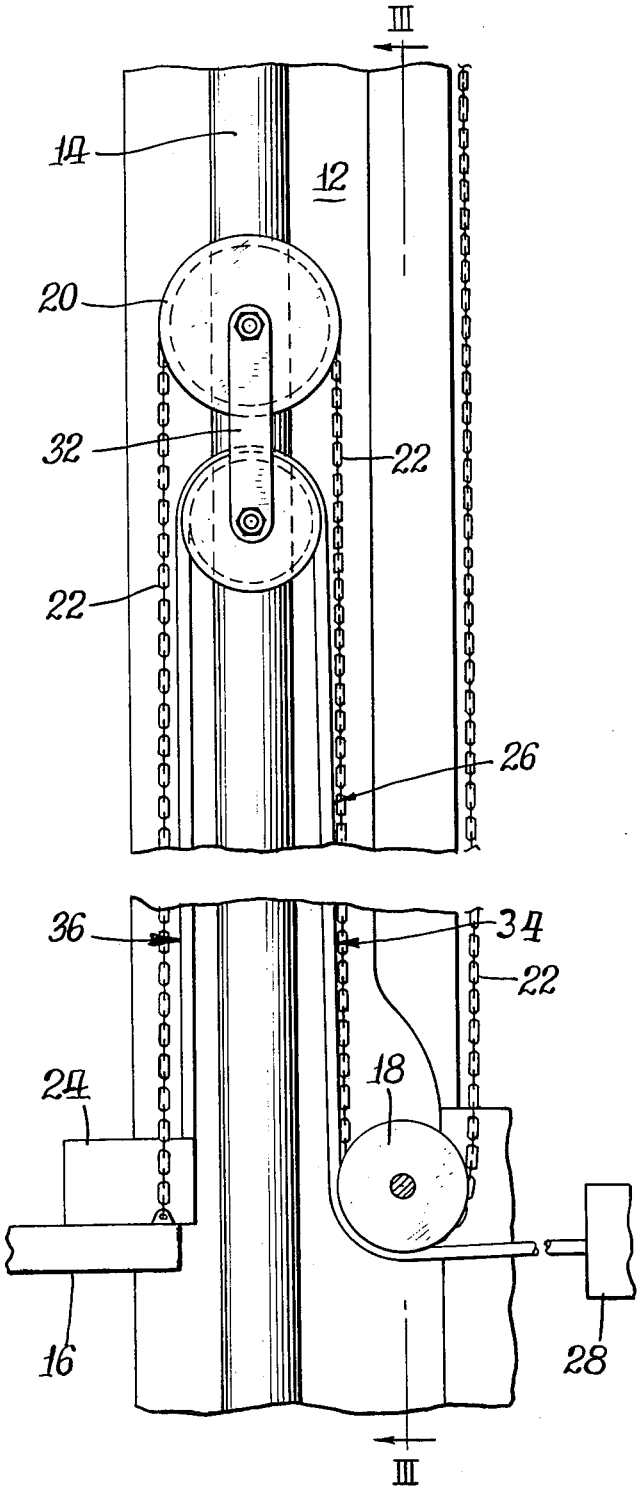
FIG. 2 is a diagrammatic partial side view of the apparatus.
Figure 3:
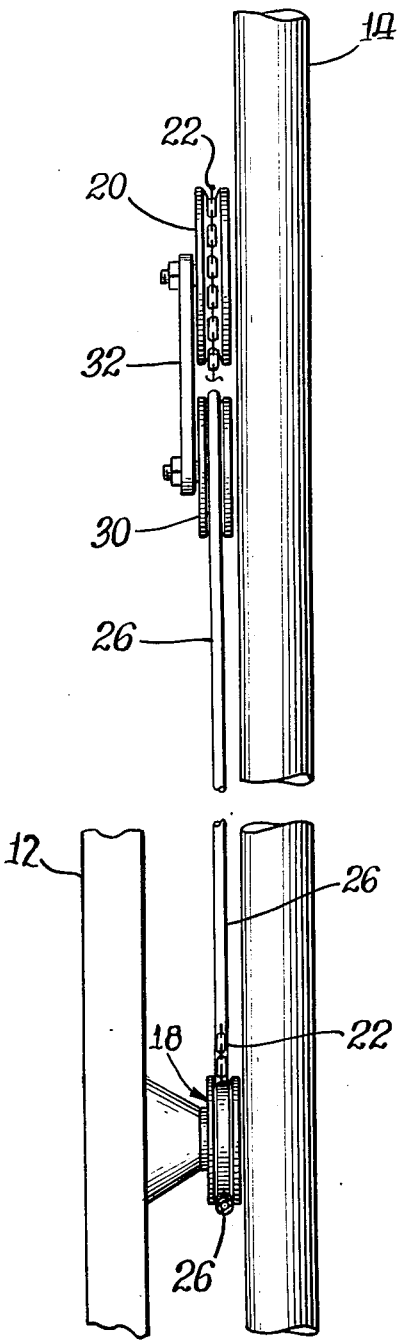
FIG. 3 is a diagrammatic partial frontal view of the apparatus.

Referring to FIGS. 2 and 3, a hose pulley 30 is connected to the second sheave 20 by bracket 32. The pulley 30 is positioned at a location immediately adjacent and beneath the second sheave 20. The hose 26 is connected to the pump 28 of the lift truck 10 and extends under the first sheave 18, over the pulley 30, and is connected to the fluid activated device 24 for passing fluid from the pump 28 to the device 24.

Referring to FIG. 3, the hose 26 is in contact with and overlying the chain 22 on the first sheave 18 and, referring to FIG. 2, the portions 34, 36 of said hose 26 extending to and from the pulley 30 are maintained by the pulley 30 adjacent and generally beneath the chain 22.

In order to assure that the hose 26 is maintained in a preselected position relative to the chain 22, it is preferred that the axis of the second sheave 20 and pulley 30 be oriented in a common direction and that said axis be in a plane substantially parallel to the plane of the mast 12. Further, to prevent abrasion of the hose 26 by the chain 22, it is preferred that the second sheave 20 be of a larger diameter than the diameter of the pulley 30, thereby maintaining the hose portions 34, 36 spaced from the chain 22.

It should be understood that where the lift truck mast assembly 11 and piston cylinder mechanism 14 are of different configuration and/or dual hoses are present, a plurality of first and second sheaves 18, 20, pulleys 30, chains 22, and hoses 26 can be provided or said sheaves 18, 20 and pulley 26 each can be constructed for serving the plural elements without departing from this invention. Further, the sheaves 18, 20 can also be attached to other structure so long as the relative positions of the chain 22 and hose 26 are maintained.

By the construction of the hose assembly of this invention, the hose 26 follows the associated chain 22 throughout the full travel length of the chain 22 and a translation of the chain 22 is followed by a substantially equal translation of hose 26. The hose is thereby prevented from damage resulting from looping about an adjacent object or being caught between the chain and a sheave. Since the hose portions 34, 36 are maintained adjacent and beneath the chain 22, the hose is also shielded and protected by the chain against damage from contact with items which might slide against the hose from the carriage.

Other aspects, objects and advantages of this invention can be obtained from a study of the disclosure and appended claims.

What is claimed is:

1. In a mast assembly having a mast, a piston cylinder elevating mechanism associated with said mast, a carriage connected to said piston cylinder elevating mechanism, a first sheave positioned at a first elevation, a second sheave positioned at a higher second elevation, a chain connected at one end to the carriage and extending under the first sheave and over the second sheave, a fluid actuated device carried by the cariage, and at least one resilient hose operably connected to the fluid actuated device, the improvement comprising:

a pulley connected to the second sheave and being positioned at a location immediately adjacent and beneath said second sheave; and said hose extending under the first sheave, over the pulley, and to the fluid actuated device, said hose being in contact with and overlying the chain on the first sheave with portions of said hose extending to and from said pulley being maintained by said pulley substantially adjacent and beneath said chain.

2. Apparatus, as set forth in claim 1, wherein the axis of the second sheave and the pulley are oriented in a common direction.

3. Apparatus, as set forth in claim 1, wherein the axis of the second sheave and the pulley are maintained in a plane substantially parallel to the plane of the mast.

4. Apparatus, as set forth in claim 1, wherein the diameter of the pulley is of a size sufficient to maintain portions of the hose positioned adjacent the chain spaced from said chain.

* * * * *